US006948836B2

(12) United States Patent
Ishida et al.

(10) Patent No.: US 6,948,836 B2
(45) Date of Patent: Sep. 27, 2005

(54) LIGHT SOURCE UNIT HAVING ORTHOGONALLY DISPOSED SEMICONDUCTOR LIGHT EMITTER

(75) Inventors: Hiroyuki Ishida, Shizuoka (JP); Masashi Tatsukawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 89 days.

(21) Appl. No.: 10/419,893

(22) Filed: Apr. 22, 2003

(65) Prior Publication Data

US 2003/0198060 A1 Oct. 23, 2003

(30) Foreign Application Priority Data

Apr. 23, 2002 (JP) ..... P.2002-120345

(51) Int. Cl.[7] ..... F21V 7/04

(52) U.S. Cl. ..... 362/516; 362/237; 362/487; 362/545; 359/548

(58) Field of Search ..... 362/31, 551, 555, 362/459, 487, 509, 516, 543, 544, 545, 227, 235, 236, 237, 247, 257, 296, 297, 310, 341, 800; 359/548, 838, 850, 851, 853, 864

(56) References Cited

U.S. PATENT DOCUMENTS

| | | | | | |
|---|---|---|---|---|---|
| 1,951,783 | A | * | 3/1934 | Beard | 250/461.1 |
| 4,868,723 | A | * | 9/1989 | Kobayashi | 362/497 |
| 4,929,866 | A | * | 5/1990 | Murata et al. | 362/545 |
| 5,136,483 | A | * | 8/1992 | Schoniger et al. | 362/545 |
| 5,148,146 | A | * | 9/1992 | Murphy | 340/461 |
| 5,471,371 | A | * | 11/1995 | Koppolu et al. | 362/545 |
| 5,642,933 | A | * | 7/1997 | Hitora | 362/243 |
| 6,086,231 | A | | 7/2000 | Kenjo et al. | |
| 6,179,456 | B1 | | 1/2001 | Nakamura et al. | |
| 6,210,028 | B1 | | 4/2001 | Murakoshi et al. | |
| 6,280,071 | B1 | | 8/2001 | Yamamoto et al. | |
| 6,406,173 | B1 | | 6/2002 | Serizawa et al. | |
| 6,411,022 | B1 | | 6/2002 | Machida et al. | |
| 6,561,689 | B1 | * | 5/2003 | Kidd et al. | 362/545 |
| 6,758,587 | B2 | * | 7/2004 | Stephens et al. | 362/545 |

FOREIGN PATENT DOCUMENTS

| | | |
|---|---|---|
| JP | 9-330604 | 12/1997 |
| JP | 2000-77689 A | 3/2000 |
| JP | 2001-332104 A | 11/2001 |
| JP | 2002-42520 A | 2/2002 |
| JP | 2002-50214 A | 2/2002 |

* cited by examiner

*Primary Examiner*—John Anthony Ward
*Assistant Examiner*—Ismael Negron
(74) *Attorney, Agent, or Firm*—Sughrue Mion, PLLC

(57) ABSTRACT

A light source unit including an LED mounted on an optical axis extending in the longitudinal direction of the vehicle with its light output directed upward, and a reflector is provided above the LED having a first reflecting surface for collecting the light emitted by the LED and reflecting the light generally in the direction of the optical axis Ax. The first reflecting surface is formed in such a manner that a distance L in a vertical direction from the LED to the first reflecting surface is approximately 10 mm in a preferred embodiment.

42 Claims, 14 Drawing Sheets

LIGHT SOURCE UNIT HAVING ORTHOGONALLY DISPOSED SEMICONDUCTOR LIGHT EMITTER

CROSS-REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

BACKGROUND OF THE INVENTION

The present invention relates to a light source unit for use in a vehicular lamp.

Conventionally, a so-called projection-type vehicular lamp implemented as a headlamp has been known.

In a projection-type vehicular lamp, light emitted by a light source disposed on the optical axis of the lamp is collected and reflected forward in the direction of the optical axis by a reflector, and the reflected light is radiated in the forward direction of the lighting unit through a projection lens mounted in front of the reflector.

By employing such a projection-type vehicular lamp it is possible to reduce the overall size of the lighting unit compared with a so-called parabolic-type vehicular lamp.

However, in the conventional projection-type vehicular lamp where a discharge light-emitting section of a discharge bulb or a filament of a halogen bulb is used for a light source thereof, the following problem occurs.

More specifically, because the actual light-emitting portion of the light source has a certain finite size, in order to appropriately reflect and control the light emitted by the light source it is necessary to provide a relatively large reflector. Moreover, it is necessary to provide a space for mounting and supporting the discharge or halogen bulb on the reflector, which further contributes to the need for a relatively large reflector. Also, the light source generates considerable heat, and the influence of the heat must be taken into consideration in the design of the reflector.

From the foregoing, there is a problem that a significant reduction in the size of the lighting unit cannot be obtained with the conventional projection-type vehicular lamp.

JP-A-2002-50214, JP-A-2001-332104 and JP-A-9-330604 disclose a vehicular lamp using an LED, which is a small-sized light source. Moreover, JP-A-2002-42520 and JP-A-2000-77689 teach a light-emitting device having a reflecting surface provided close to an LED. These references do not, however, teach a light source suitable for use in a vehicular headlamp or the like.

BRIEF SUMMARY OF THE INVENTION

In consideration of the problems mentioned above, it is an object of the invention to provide a light source unit which allows the size of a vehicular lamp to be significantly reduced.

To achieve the above and other objects, the invention employs a semiconductor light-emitting element as a light source together with an appropriately designed reflector.

More specifically, the invention provides a light source unit for use in a vehicular lamp, comprising a semiconductor light-emitting element arranged on the optical axis of the light source unit with its light output directed in a predetermined direction substantially orthogonal to the optical axis, and a reflector provided on a forward side in the predetermined direction with respect to the semiconductor light-emitting element and having a first reflecting surface to collect light emitted by the semiconductor light-emitting element and reflect the light forward in the direction of the optical axis, wherein the first reflecting surface is formed in such a manner that the distance in the predetermined direction from the semiconductor light-emitting element to the first reflecting surface has a value of 20 mm or less. The term "light output directed in a predetermined direction" means that the central axis of the generally hemispherical light flux produced by the semiconductor light-emitting element is directed in the predetermined direction.

The vehicular lamp in which the light source unit of the invention can be employed is not restricted to a specific type of lamp, and it may be embodied as a headlamp, a fog lamp or a cornering lamp, for example.

The optical axis of the light source unit may extend in the longitudinal direction of the vehicle or in another direction.

The above-mentioned predetermined direction is not restricted to a specific direction as long as it is substantially orthogonal to the optical axis of the light source unit, and it can be in the upward, transverse or downward direction with respect to the optical axis.

While the specific type of the semiconductor light-emitting element is not particularly limited, an LED (light-emitting diode) or an LD (laser diode) can be employed, for example.

As described herein, the invention provides a light source unit comprising a semiconductor light-emitting element arranged on the optical axis of the light source unit with its light output directed in a predetermined direction substantially orthogonal to the optical axis, and a reflector extending on a forward side in the predetermined direction with respect to the semiconductor light-emitting element and having a first reflecting surface to collect light emitted by the semiconductor light-emitting element and reflect the light forward in the direction of the optical axis, wherein the first reflecting surface of the reflector is formed in such a manner that the distance in the predetermined direction from the semiconductor light-emitting element to the first reflecting surface is 20 mm or less. With this construction, the size of the reflector can be reduced considerably compared with a reflector used in a conventional projection-type vehicular lamp.

Because a semiconductor light-emitting element is used as the light source, the light source can be treated substantially as a point light source. Thus, even if the size of the reflector is reduced, the light emitted by the semiconductor light-emitting element can be appropriately reflected and controlled by the reflector. In addition, the semiconductor light-emitting element is arranged with its light output directed in a predetermined direction substantially orthogonal to the optical axis of the light source unit. Consequently, most of the light emitted by the semiconductor light-emitting element is reflected by the first reflecting surface and utilized in the output light beam from the light source.

Moreover, since a semiconductor light-emitting element is used as the light source, it is not necessary to provide a large space such as needed for mounting a discharge or halogen bulb on the reflector, thereby further contributing to a reduction in the size of the reflector. In addition, semiconductor light-emitting elements emit little heat, again promoting a reduction in the size of the reflector.

Accordingly, by using a light source unit constructed according to the invention in a vehicular lamp, it is possible to considerably reduce the overall size of the vehicular lamp.

One or a plural number of light source units constructed according to the invention may be used in a vehicular lamp. In the latter case, the brightness of the vehicular lamp can be increased corresponding to the number of light source units. The arrangement of the plural light source units can easily be set in accordance with the given design parameters. That is, the use of light source units of the invention results in a wide latitude in designing a vehicular lamp.

A second reflecting surface may be provided at the front end in the direction of the optical axis of the first reflecting surface, and the second reflecting surface may be inclined forwardly in the direction of the optical axis, the solid angle subtended by the reflector can be increased correspondingly. Consequently, the proportion of the luminous flux from the light source unit utilized in the output beam can be further increased.

Moreover, if a light control member (shade) for shielding a part of the light reflected by the first reflecting surface is provided at a predetermined position on a forward side of the semiconductor light-emitting element in the direction of the optical axis, it is possible to form a light distribution pattern having a cut-off line such as a low-beam distribution pattern of a headlamp.

Further, by extending a shielding end face of the light control member rearward in the direction of the optical axis and by forming a third reflecting surface for reflecting the light reflected by the first reflecting surface in the above-mentioned predetermined direction with the shielding end face, light which would otherwise have been shielded by the light control member can effectively be used in the formation of the output light beam. Thus, the luminous flux provided by the light source unit can be yet further increased.

In the case in which the light source unit according to the invention is used in a vehicular lamp, a projection lens is generally required. The light source unit according to the invention may incorporate the projection lens, although this need not always be the case. If a projection lens is to be included with the light source unit, the projection lens may be provided at a predetermined position on the forward side in the direction of the optical axis with respect to the reflector. In the latter case where the projection lens is not directly integrated with the light source unit, it is preferable that the projection lens is still provided at the predetermined position on the forward side in the direction of the optical axis with respect to the light source unit. However, in the case where the projection lens is integrated with the structure of the light source unit the positional relationship among the projection lens and the reflector (as well as the light control member, if present) can be established with a high degree of precision prior to final assembly of the vehicular lamp. Consequently, it is possible to more easily assemble the vehicular lamp.

DETAILED DESCRIPTION OF THE INVENTION

Preferred embodiments of the invention will be described below with reference to the drawings.

Figure 1:
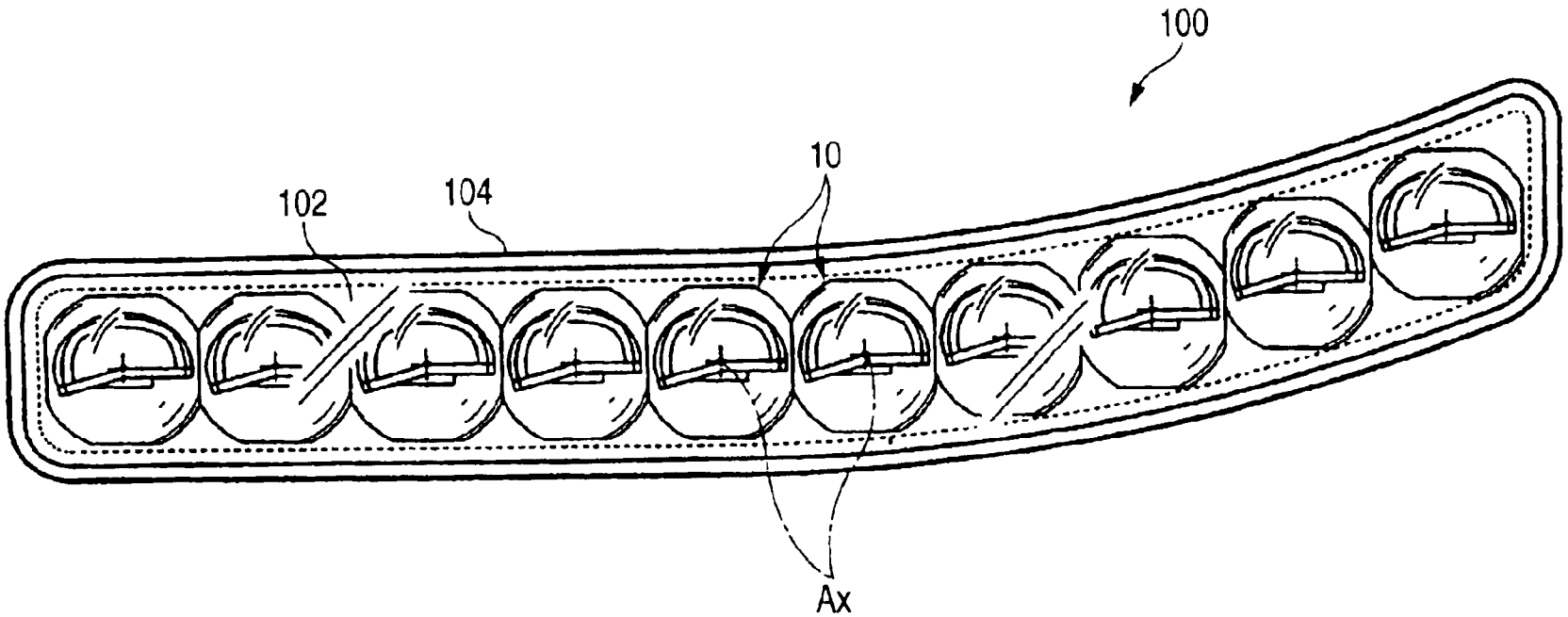
FIG. 1 is a front view showing a first example of a vehicular lamp which includes plural light source units constructed according to a first embodiment of the invention.

FIG. 1 is a front view showing a vehicular lamp 100 which incorporates a light source unit 10 constructed according to a first embodiment of the invention.

The vehicular lamp, or lighting unit, 100 is a low-beam headlamp incorporating ten light source units 10 arranged in a substantially horizontal line in a lamp housing formed by a transparent cover 102 and a lamp body 104.

The light source units 10, which all have the same structure, are accommodated in the lamp housing with their optical axes Ax extending generally in the longitudinal direction of the vehicle, more specifically, in a downward direction by approximately 0.5 to 0.6 degree with respect to the longitudinal direction of the vehicle.

Figure 2:
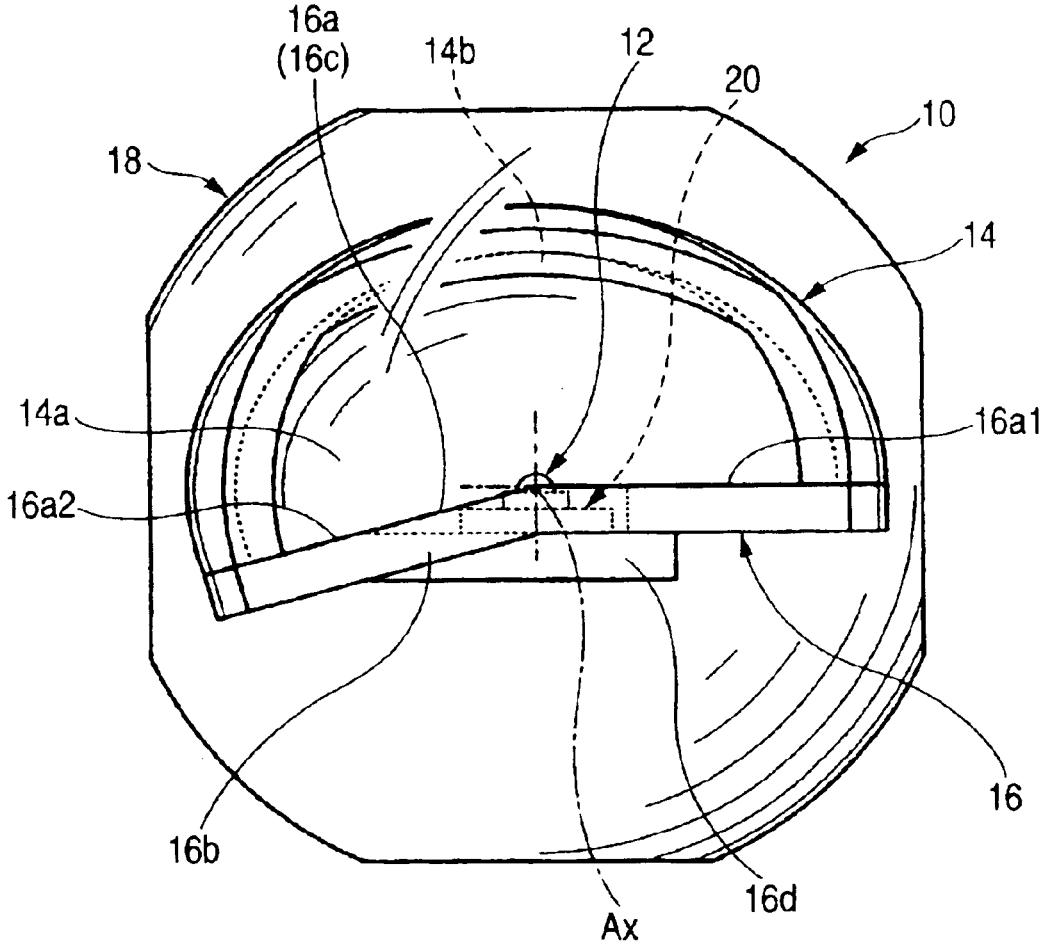
FIG. 2 is a front view showing a light source unit included in the vehicular lamp of FIG. 1.
Figure 3:
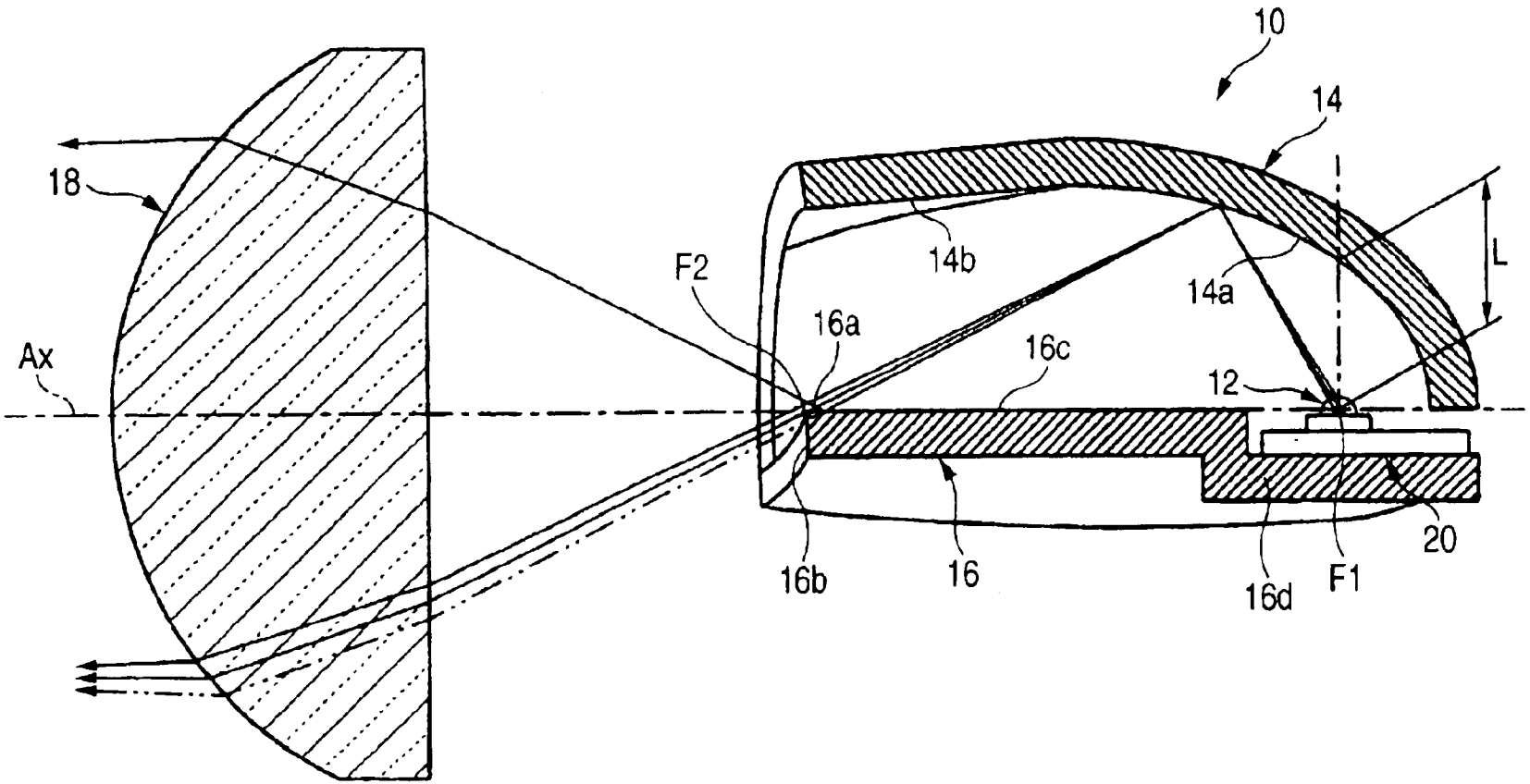
FIG. 3 is a sectional side view showing the light source unit of FIG. 1.
Figure 4:
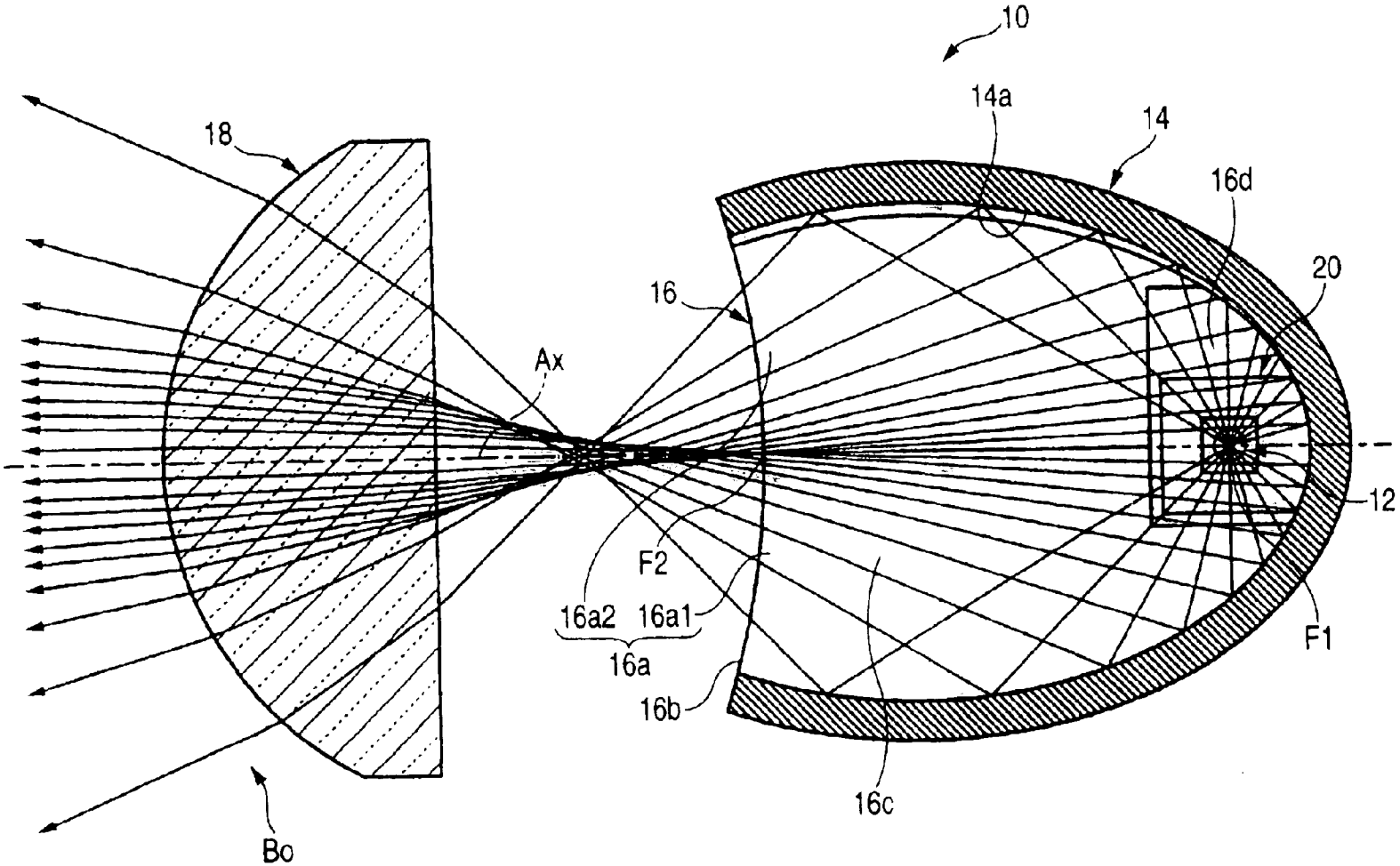
FIG. 4 is a sectional plan view showing the light source unit of FIG. 1.

FIG. 2 is a front view showing a single light source unit 10, and FIGS. 3 and 4 are sectional side and plan views, respectively, of the light source unit 10.

As shown in these drawings, the light source unit 10 includes an LED 12 (a semiconductor light-emitting element) as a light source, a reflector 14, a light control member 16 and a projection lens 18.

The LED 12, which is a white LED including a light-emitting section having a size of approximately 1 mm square, is supported on a substrate 20 at a position on the optical axis Ax with its light output directed upward.

The reflector 14, which is a substantially dome-shaped member provided on the upper side of the LED 12, has a first reflecting surface 14*a* for collecting the light emitted by the LED 12 and reflecting the light forward in the direction of the optical axis Ax. The first reflecting surface 14*a* is formed in such a manner that the distance L in a vertical direction from the LED 12 to the first reflecting surface 14*a* is 20 mm or less, preferably approximately 10 mm.

The first reflecting surface 14*a* is substantially elliptically shaped in cross section with the optical axis Ax as its central axis. More specifically, the first reflecting surface 14*a* has a sectional shape in a planar section including the optical axis Ax which is substantially elliptical, but with an eccentricity which gradually increases from a vertical section toward a horizontal section and with the vertex at the rear side of the ellipse for all sections being the same. The LED 12 is positioned at a first focal point F1 of the ellipse in the vertical section of the first reflecting surface 14*a*. With this configuration, the first reflecting surface 14*a* collects and reflects in the direction of the optical axis Ax the light emitted by the LED 12, and substantially converges the light at a second focal point F2 of the ellipse in the vertical section on the optical axis Ax.

The upper part of the front end of the first reflecting surface 14*a* of the reflector 14 is provided with a second reflecting surface 14*b* which is inclined downward with respect to the optical axis Ax in a forward direction from the first reflecting surface 14*a*.

The projection lens 18, which is disposed on the optical axis Ax, causes the focal position on the rear side to be coincident with the second focal point F2 of the first reflecting surface 14*a* of the reflector 14. Consequently, an image formed on a focal plane including the second focal point F2 is projected forward as an inverted image. The projection lens 18 is a planoconvex lens with the surface on the forward side being a convex surface and the surface on the rearward side being a planar surface. Four vertical and transverse portions of the lens which are not used in focusing light are chamfered to reduce the size and weight of the lens.

The light control member 16 is provided between the LED 12 and the projection lens 18. The light control member 16, which has a shielding end face 16*a* which is substantially turned down at the corner as seen from the front, shields a part of the light reflected by the first reflecting surface 14*a* with the shielding end face 16*a* while reflecting most of the light upward toward the projection lens 18.

More specifically, the shielding end face 16*a* has a horizontal cut-off line forming surface 16*a*1 extending horizontally in a leftward direction from the optical axis Ax and an oblique cut-off line forming surface 16*a*2 extending obliquely and downward by about 15 degrees in a rightward direction from the optical axis Ax. The shielding end face 16*a* is formed in such a manner that the front edge of the shielding end face 16*a* (a ridgeline between the shielding end face 16*a* and a front end face 16*b* of the light control member 16) coincides with the second focal point F2. The shielding end face 16*a* extends rearward, and the surface thereof is reflecting. A third reflecting surface 16*c* for reflecting light reflected by the first reflecting surface 14*a* upward is formed by the extended shielding end face 16*a*.

The front end face 16*b* of the light control member 16 is formed in such a manner that both left and right sides are curved forward following an imaginary surface corresponding to the image surface of the projection lens 18.

A substrate support section 16*d* is formed on the rear end of the light control member 16, and the substrate 20 is fixed to the light control member 16 in the substrate support section 16*d*.

The reflector 14 is fixed to the light control member 16 at the peripheral edge portion of a lower end thereof. Furthermore, the projection lens 18 is also fixed to the light control member 16 through a bracket (not shown).

Figure 5:
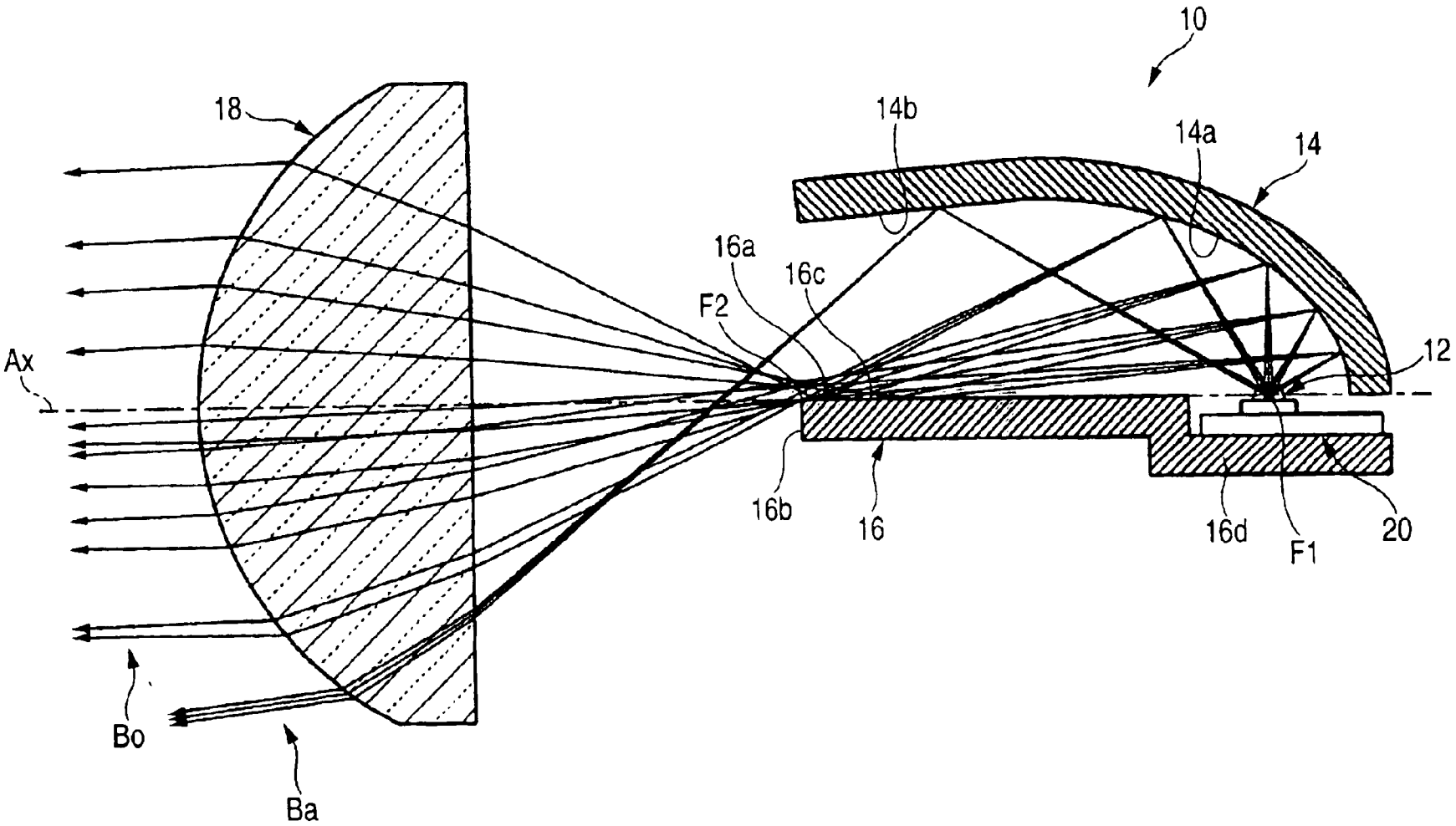
FIG. 5 is a sectional side view showing in detail the optical path of a beam radiated from the light source unit of FIG. 1.

FIG. 5 is a sectional side view showing in detail the optical paths of various beams which compose the light flux radiated from the light source unit 10.

As shown in FIG. 5, a part of the light which is emitted by the LED 12 and reflected by the first reflecting surface 14*a* of the reflector 14 is shielded by the light control member 16, while the remaining part of the light is directly incident on the projection lens 18. The light shielded by the light control member 16 is also reflected upward by the third reflecting surface 16*c* formed on the shielding end face 16*a* and is then incident on the projection lens 18. The light which is thus incident on the projection lens 18 and transmitted therethrough is emitted as low-beam radiated light Bo forward from the projection lens 18.

On the other hand, the light emitted by the LED 12 which is reflected by the second reflecting surface 14*b* of the reflector 14 is directly incident on the projection lens 18, passing over the second focal point F2, and is emitted as additional radiated light Ba forward from the projection lens 18. The additional radiated light Ba is directed further downward than the low-beam radiated light Bo.

Figure 6:
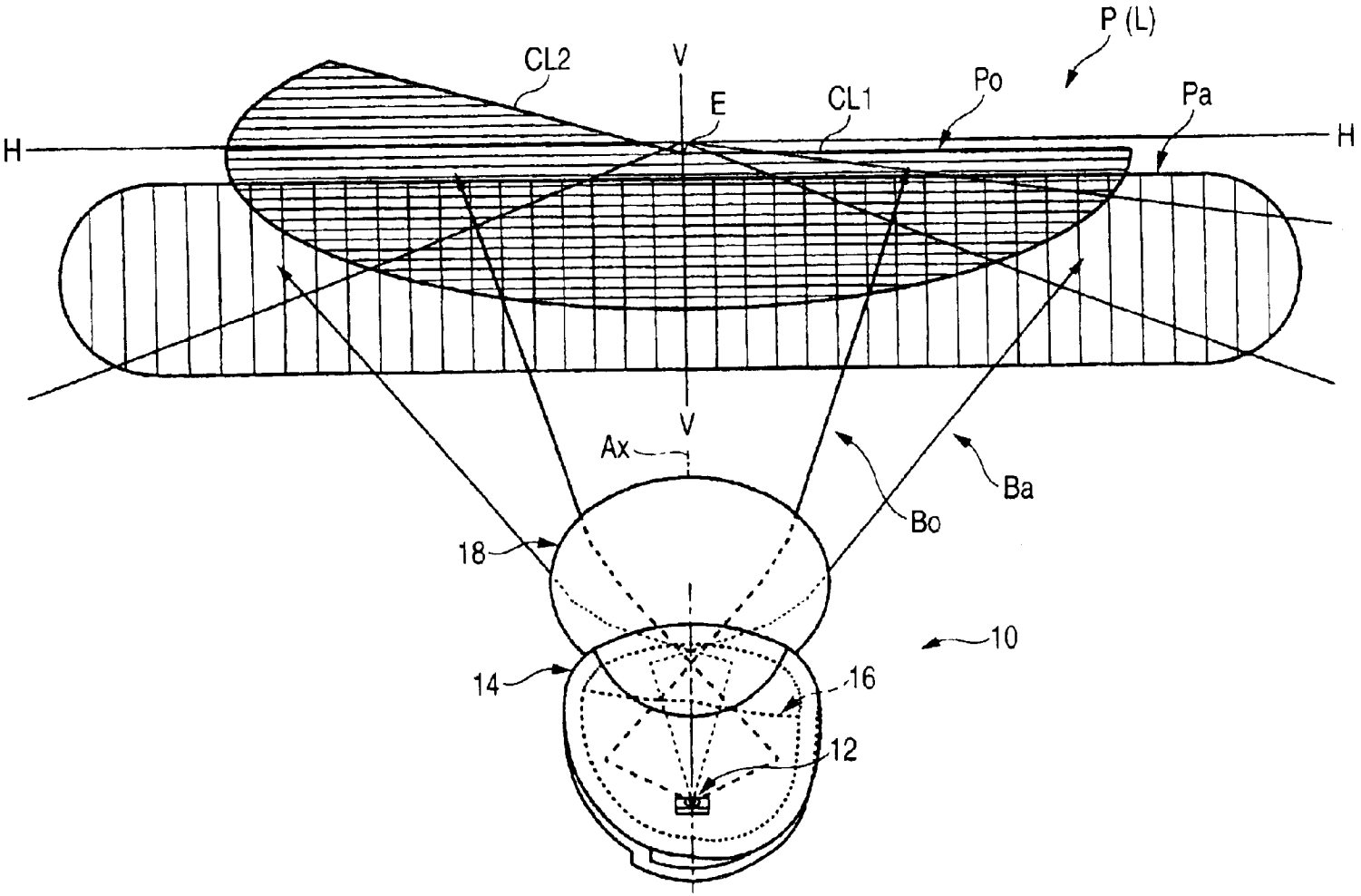
FIG. 6 is a perspective view showing a light distribution pattern formed on a virtual vertical screen at a position 25 m forward of a light source unit of the invention by a beam from the light source unit together with the light source unit as seen from the rear side thereof.

FIG. 6 is a perspective view showing a low-beam distribution pattern P(L) formed on a virtual vertical screen disposed at a position 25 m forward of the lighting unit by a beam radiated forward from the light source unit 10. FIG. 6 also shows the light source unit 10 as seen from the rear side thereof.

As shown in FIG. 6, the low-beam distribution pattern P(L) is formed as a synthesized light distribution pattern including a basic light distribution pattern Po and an additional light distribution pattern Pa.

The basic light distribution pattern Po, which is a leftward light distribution pattern formed by the light reflected from the first reflecting surface 14*a* (the low-beam radiated light Bo), has horizontal and oblique cut-off lines CL1 and CL2 on the upper edge thereof The horizontal cut-off line CL1 is formed as the inverted image of the horizontal cut-off line forming surface 16*a*1 of the light control member 16 on the right side of the H-V intersection (the intersection of horizontal and vertical axes just in front of the lighting unit), and the oblique cut-off line CL2 is formed as the inverted image of the oblique cut-off line forming surface 16*a*2 of the light control member 16 on the left side of the H-V intersection. The position of the intersection point (elbow point) E of the horizontal cut-off line CL1 and the oblique cut-off line CL2 is slightly below the position of the H-V intersection (downward at an angle of approximately 0.5 to 0.6 degree). Visibility in distant portions of the road surface in front of the vehicle is maintained by the basic light distribution pattern Po.

On the other hand, the additional light distribution pattern Pa, which is a light distribution pattern formed by the light reflected by the second reflecting surface 14*b* (the additional radiated light Ba), overlaps with the lower half part of the basic light distribution pattern Po and is diffused widely in the transverse direction. Visibility in short-distance regions on the road surface in front of the vehicle is maintained by the additional light distribution pattern Pa.

The vehicular lamp 100 according to this example employs ten light source units 10. Therefore, beam radiation is performed with a synthesized light distribution pattern wherein the low-beam distribution patterns P(L) formed by each of the ten light source units 10 are combined. Consequently, the brightness necessary for low-beam illumination by the headlamp is attained.

As described above in detail, the light source unit 10 according to the first embodiment includes the LED 12, whose light output is directed upward and which is positioned on the optical axis Ax extending in the longitudinal direction of the vehicle, and the reflector 14, which includes the first reflecting surface 14*a* for collecting and reflecting the light emitted by the LED 12 generally in the direction of the optical axis Ax and which is provided on the upper side of the LED 12. The first reflecting surface 14*a* of the reflector 14 is formed in such a manner that the distance in the vertical direction from the LED 12 to the first reflecting surface 14*a* is approximately 10 mm. With this construction, the reflector 14 can be made considerably smaller than a reflector used in a conventional projection-type vehicular lamp.

Since the LED 12 is used as a light source, the light source can be treated substantially as a point light source. Thus, even though the size of the reflector 14 is reduced, the light emitted by the LED 12 nevertheless can be appropriately reflected and controlled by the reflector 14. In addition, the LED 12 is arranged in such a direction as to be substantially orthogonal to the optical axis Ax of the light source unit 10. Therefore, most of the light emitted by the LED 12 can be utilized as light reflected by the first reflecting surface 14*a*.

Moreover, because the LED 12 is used as the light source, it is not necessary to provide a large mounting space, such as is needed when a discharge or halogen bulb is used as in the conventional art. Also in this respect the size of the reflector 14 can be reduced. In addition, because the LED 12 generates very little heat, the influence of heat does not need to be considered in the design of the reflector, further contributing to a reduction in size of the reflector.

Accordingly, when the light source unit 10 according to the invention is used in a vehicular lamp, the size of the lamp can be considerably reduced.

The vehicular lamp 100 according to the above-described example is a low-beam headlamp which employs ten light source units 10 so that the necessary brightness for low-beam radiation can be attained. It is to be noted that the arrangement of the light source units 10 within the headlamp can easily be set optionally, and consequently the freedom in designing the shape of the vehicular lamp is enhanced.

In the above-described embodiment, the first reflecting surface 14*a* of the reflector 14 is formed in such a manner that the distance L in the vertical direction from the LED 12 to the first reflecting surface 14*a* is approximately 10 mm. Even if the distance L is slightly more than 10 mm (that is, 20 mm or less, preferably 16 mm or less, and more preferably 12 mm or less), the reflector 14 still can be made considerably smaller than a reflector used in a conventional projection-type vehicular lamp.

In this embodiment, the front end of the first reflecting surface 14*a* of the reflector 14 is provided with the second reflecting surface 14*b* extending forward and inclined with respect to the optical axis Ax. Therefore, the solid angle subtended by the reflector 14 can further be increased correspondingly. Consequently, the amount of luminous flux from the light source unit 10 which is utilized in the output beam can be further increased.

Moreover, because the light control member 16 for shielding a part of the light reflected by the first reflecting surface 14*a* is provided at a predetermined position on the forward side with respect to the LED 12, the output beam from the light source 10 includes the low-beam distribution pattern P(L) having the horizontal and oblique cut-off lines CL1 and CL2.

For this purpose, the light control member 16 is provided with the shielding end face 16*a* which extends rearward and the third reflecting surface 16*c* for reflecting the light reflected by the first reflecting surface 14*a* in the upward direction. Therefore, even light which is shielded by the light control member 16 can be effectively utilized in the output beam. Consequently, the luminous flux from the light source unit 10 is efficiently utilized. However, in place of the light control member 16 according to the above-described embodiment, it is also possible to provide a light control member having only the function of shielding a part of the light reflected by the first reflecting surface 14*a*.

Furthermore, since the light source unit 10 according to this embodiment incorporates the projection lens 18, the positional relationship between the projection lens 18 and the reflector 14 and light control member 16 can be established with high precision at a stage prior to final assembly of the lighting unit 100. Consequently, the lighting unit 100 can easily be assembled.

Figure 7:
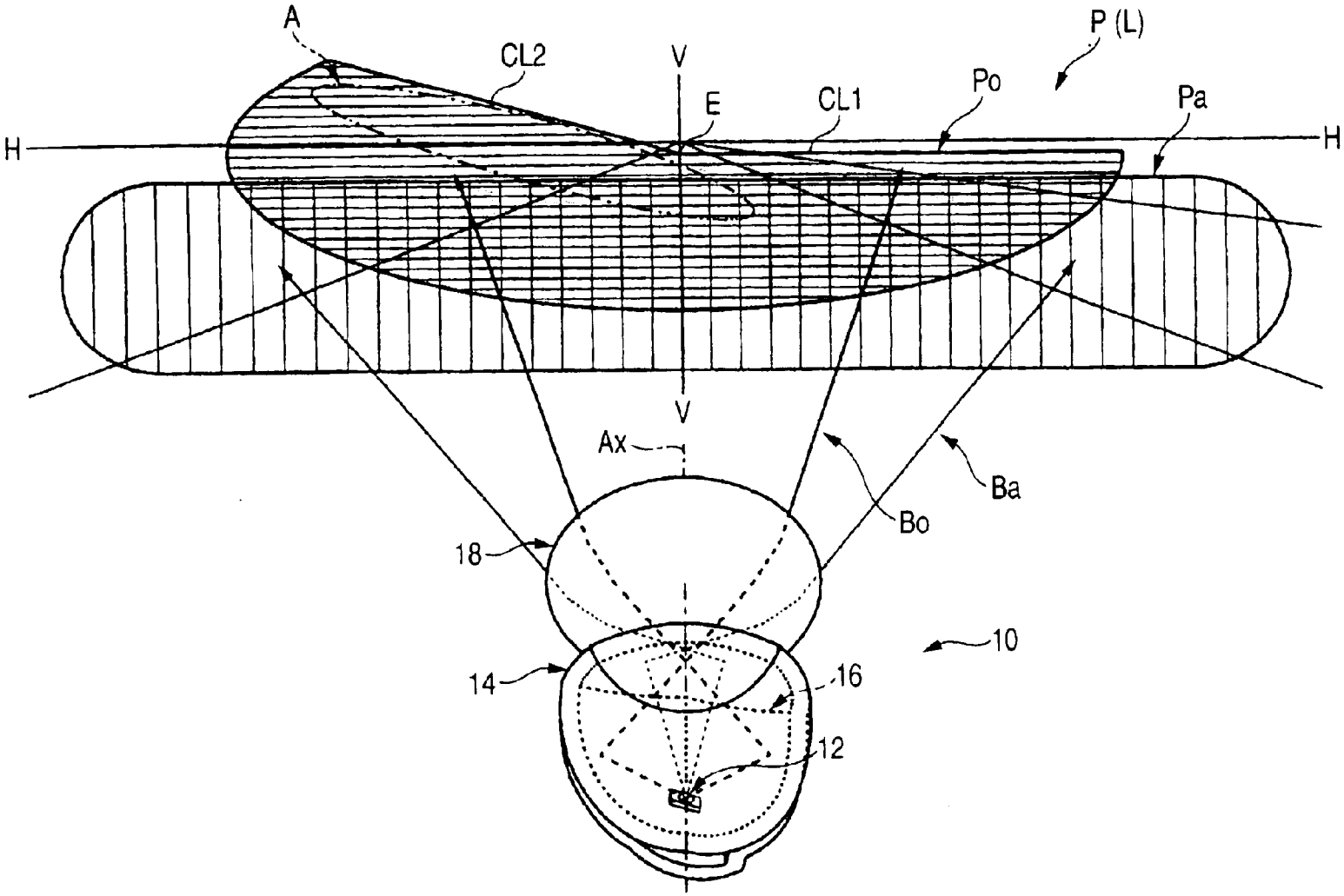
FIG. 7 is a view showing an alternate arrangement of an LED in the embodiment of FIG. 6.

While the LED 12 is arranged with its light output directed in the upward direction in the light source unit 10 according to the above-described embodiment, that is, with its light output substantially orthogonal to the horizontal cut-off line forming surface, it may rotated, for example, by 15 degrees in a rightward direction about the optical axis Ax, as shown in FIG. 7. In such a case, the following functions and effects can be obtained.

Generally, the light distribution curve of the light emitted by the LED has a luminous intensity distribution in which the directly forward direction of the LED has a maximum luminous intensity and the luminous intensity decreases as the angle with respect to the directly forward direction is increased. Therefore, by rotating the LED 12 by 15 degrees as described above, a lower region (indicated by a two-dot chain line in FIG. 7) A of the oblique cut-off line CL2 in the basic light distribution pattern Po can be illuminated more brightly. Consequently, the low-beam distribution pattern P(L) is improved for distant visibility.

In this embodiment, the shielding end face 16*a* of the light control member 16 includes the horizontal cut-off line forming surface 16*a*1 and the oblique cut-off line forming surface 16*a*2 in order to form the low-beam distribution pattern P(L) having the horizontal and oblique cut-off lines CL1 and CL2. However, the shielding end face 16*a* of the light control member 16 may have a different shape from that previously described in order to form a low-beam distribution pattern having a different cut-off line pattern (a transversely uneven stepped horizontal cut-off line, for example). It is possible to obtain the same functions and effects as those of the above-described first embodiment in such a case by employing the same structure as that of the first embodiment.

Next, a second embodiment of the embodiment will be described.

Figure 8:
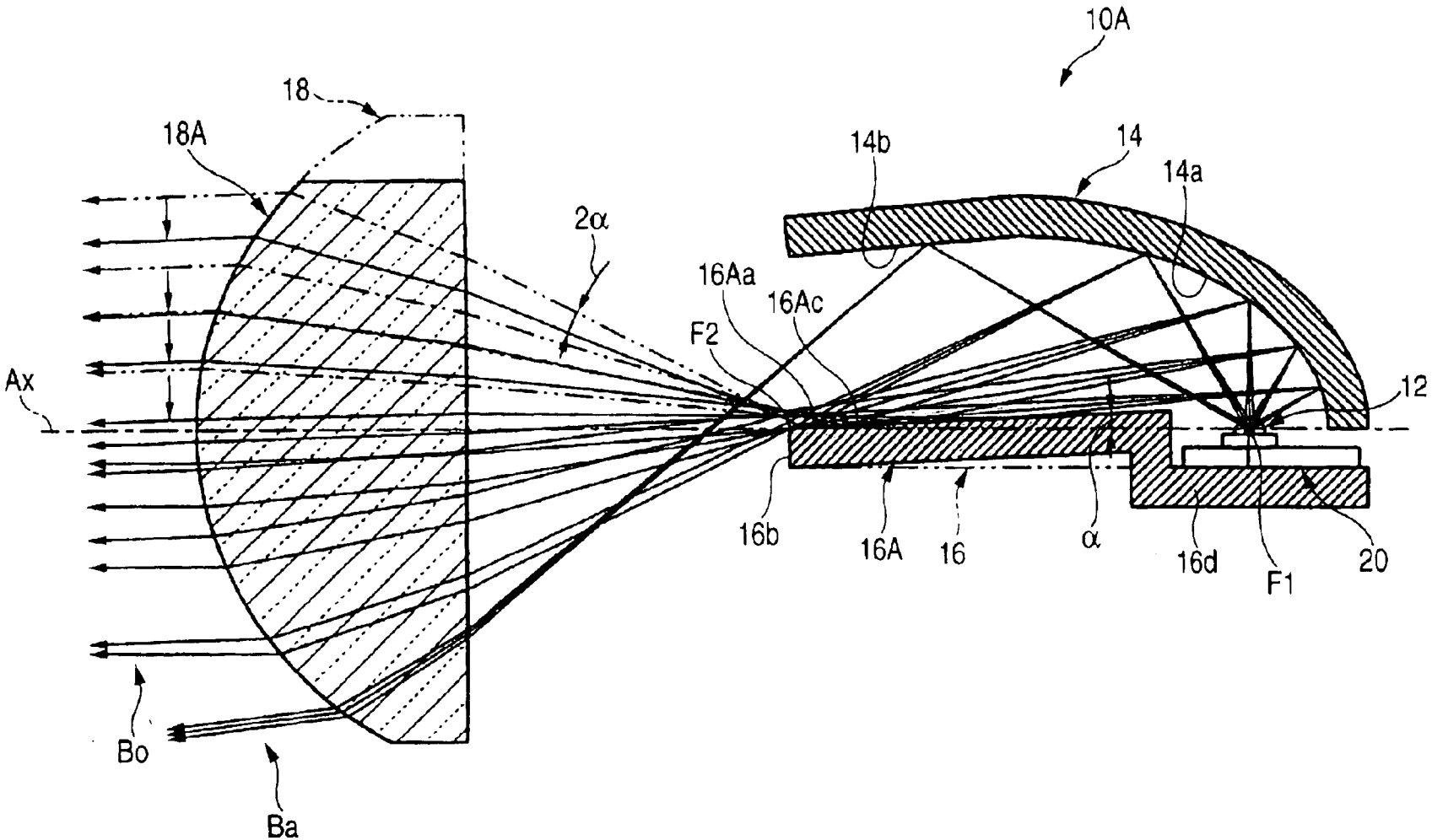
FIG. 8 is a view similar to FIG. 5 showing a second embodiment of a light source unit of the invention.

FIG. 8 is a sectional side view showing a light source unit 10A according to the second embodiment.

As shown in FIG. 8, the light source unit 10A employs different structures for the light control member 16A and projection lens 18A than those of the light control member 16 and the projection lens 18 according to the first embodiment, while other structures are the same as those in the first embodiment.

The shape of a front end face 16*b* of the light control member 16A is the same as that of the light control member 16 (indicated by a two-dot chain line in FIG. 8) of the first embodiment, while a shielding end face 16A*a* is inclined slightly upward and rearward from the front end face 16*b*. The angle of inclination α may be approximately 1 to 10 degrees, for example.

The shielding end face 16Aa is formed so that a third reflecting surface 16Ac for reflecting the light reflected by the first reflecting surface 14*a* upward is also formed at an angle of upward inclination α. Consequently, the angle of upward inclination of the light reflected by the third reflecting surface 16Ac is reduced by an angle of 2α as compared with the previously described embodiment (the optical path of the reflected light is indicated by a two-dot chain line in the drawing). Accordingly, the position at which light reflected by the third reflecting surface 16Ac is incident on the projection lens 18A is lower than that in the previously described embodiment.

For this reason, the projection lens 18A according to the second embodiment is cut away at an upper end portion where no light reflected by the third reflecting surface 16Ac is incident (as indicated by a two-dot chain line in FIG. 8).

By employing the structure of the second embodiment, the height of the projection lens 18A can be decreased. Consequently, the size of the light source unit 10A can be reduced still further.

Next, another example of a vehicular lamp employing light source units of the invention will be described.

Figure 9:
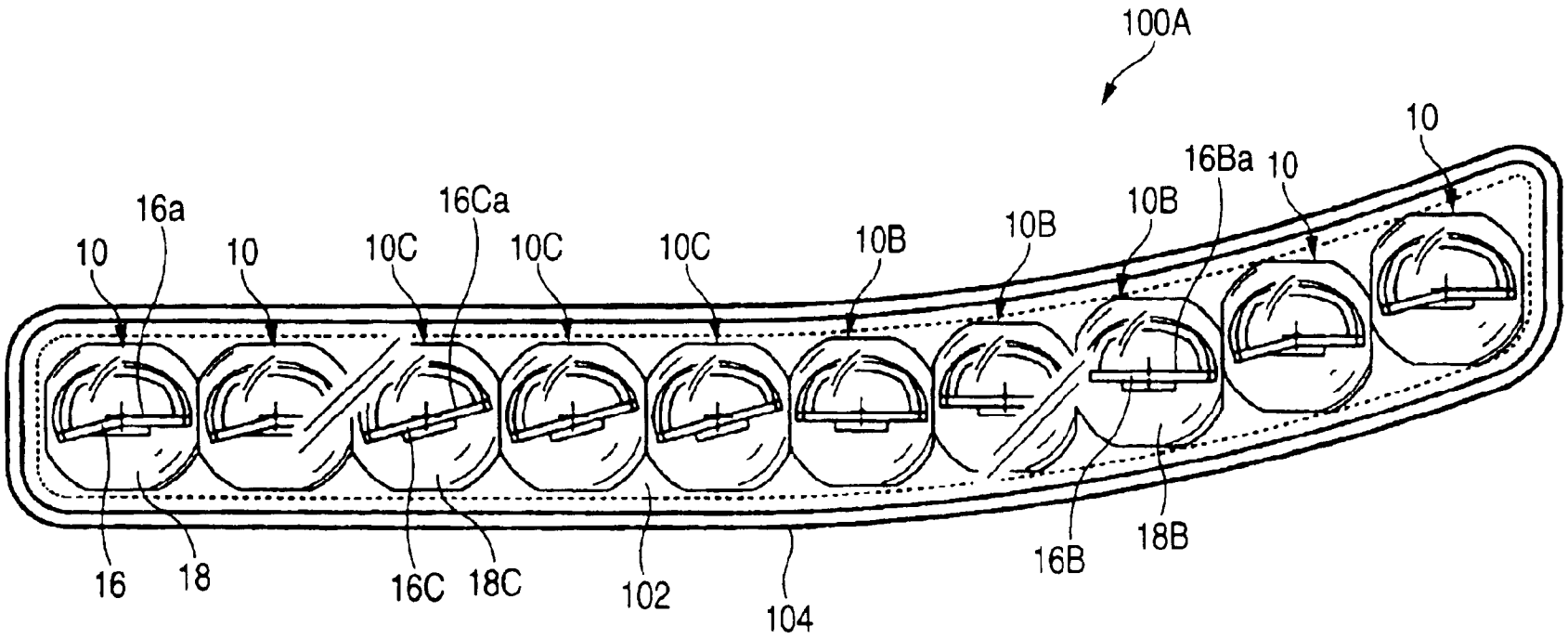
FIG. 9 is a view similar to FIG. 1 showing a second example of a vehicular lamp employing plural light source units of the invention.

FIG. 9 is a front view showing a vehicular lamp 100A according to this example.

As in the case of the first example shown in FIG. 1, the vehicular lamp 100A is also a low-beam headlamp employing ten light source units arranged in a substantially horizontal line. This example differs from the first and example in that the light source units are constituted by a combination of different types of light source units.

More specifically, four of the ten light source units are the same as those of the first example, while the other six light source units are used for forming a hot zone (a high luminous intensity region). Of the latter group, three are light source units 10B for horizontal cut-off line formation and the other three are light source units 10C for oblique cut-off line formation.

A light source unit 10B for forming the horizontal cut-off line has the same basic structure as the light source unit 10, but they differ from each other in the following respect. More specifically, the entire shielding end face 16Ba of the light control member 16B, which acts as a horizontal cut-off line forming surface, extends horizontally in both leftward and rightward directions from the optical axis Ax of the light source unit 10B. In the light source unit 10B, moreover, a lens having a greater rear focal length than that of the projection lens 18 of the light source unit 10 is used for the projection lens 18B.

On the other hand, the light source unit 10C for forming the oblique cut-off line also has the same basic structure as that of the light source unit 10, but they differ from each other in the following respect. More specifically, in the light source unit 10C, the entire shielding end face 16Ca of the light control member 16C, which acts as the oblique cut-off line forming surface, extends obliquely and upward by 15 degrees in a leftward direction from the optical axis Ax and obliquely and downward by 15 degrees in a rightward direction. In the light source unit 10C, moreover, a lens having a much greater rear focal length than that of the projection lens 18B of the light source unit 10B is used for the projection lens 18C. Also, the LED 12 of the light source unit 10C is rotated by 15 degrees in the rightward direction about the optical axis Ax from the vertical direction (see FIG. 11).

Figure 10:
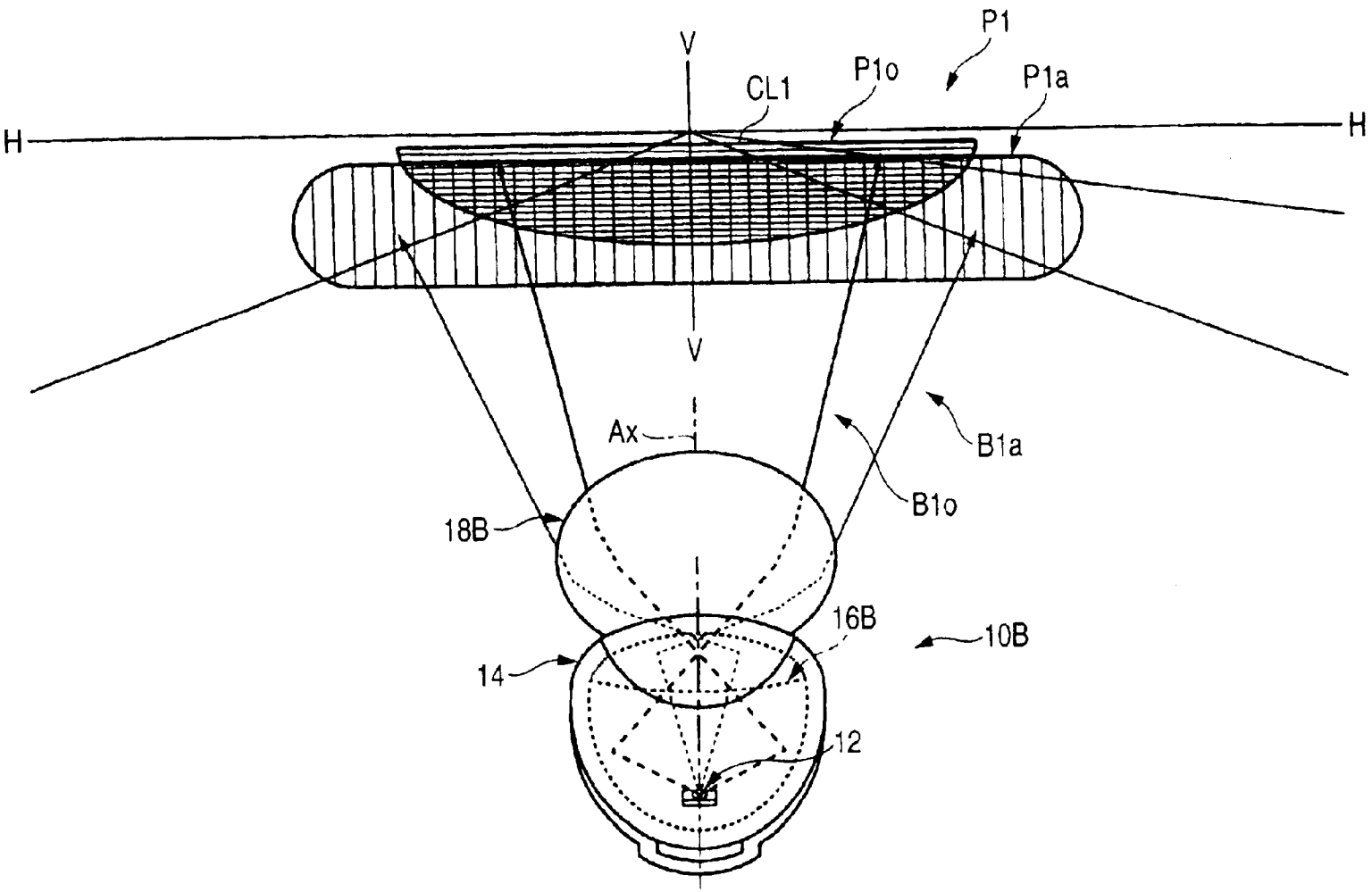
FIG. 10 is a perspective view showing a light distribution pattern formed on a virtual vertical screen by a beam having a horizontal cut-off line, together with a light source unit of the second embodiment as seen from the rear side thereof.

FIG. 10 is a perspective view showing a light distribution pattern P1 for forming the horizontal cut-off line as seen on a virtual vertical screen positioned 25 m forward of the lighting unit. The light distribution pattern P1 is formed by a beam radiated forward from the light source unit 10B. The light distribution pattern P1 is shown together with the light source unit 10B as viewed from the rear side thereof.

As shown in FIG. 10, the light distribution pattern P1 for forming the horizontal cut-off line is formed as a synthesized light distribution pattern including a basic light distribution pattern P1*o* and an additional light distribution pattern P1*a*.

The basic light distribution pattern P1*o* is formed by light reflected from the first reflecting surface 14*a*, namely, radiated light B1*o* for forming the hot zone, and it has a horizontal cut-off line CL1 on the upper edge thereof. The horizontal cut-off line CL1 is formed at the same level as the horizontal cut-off line CL1 formed from the light source unit 10.

The projection lens 18B of the light source unit 10B has a greater rear focal length than that of the projection lens 18 of the light source unit 10. As compared with the basic light distribution pattern Po formed by the light source unit 10, therefore, the basic light distribution pattern P1*o* is smaller and brighter. Consequently, the basic light distribution pattern P1*o* includes a hot zone formed along the horizontal cut-off line CL1 which enhances the visibility of distant regions on the road surface in front of the vehicle.

On the other hand, the additional light distribution pattern P1*a* is formed by light reflected from the second reflecting surface 14*b* (additional radiated light B1*a*), and is formed to overlap with the lower half part of the basic light distribution pattern P1*o* while being diffused widely in the transverse direction. The additional light distribution pattern P1*a* is also a smaller light distribution pattern than the additional light distribution pattern Pa formed by the light source unit 10 due to the greater rear focal length of the projection lens 18B. Visibility in the region on the side of the basic light distribution pattern P1*o* on the road surface forward of the vehicle is enhanced due to the provision of the additional light distribution pattern P1*a*.

Figure 11:
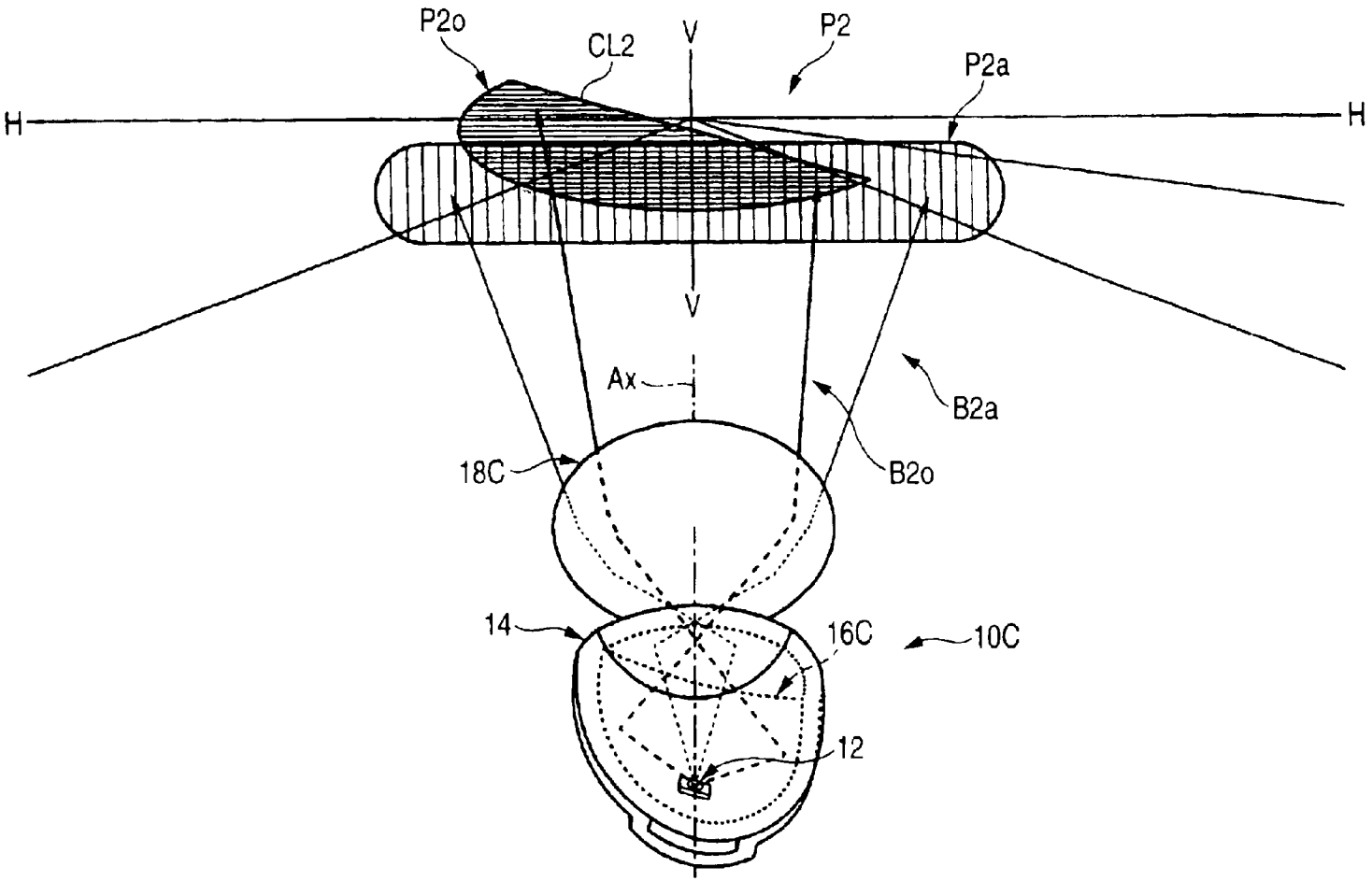
FIG. 11 is a perspective view showing a light distribution pattern formed on the virtual vertical screen by a beam having an oblique cut-off line, together with a light source unit of the second embodiment as seen from the rear side thereof.

FIG. 11 is a perspective view showing a light distribution pattern P2 for forming the oblique cut-off line as seen on a virtual vertical screen positioned 25 m forward of the lighting unit. The light distribution pattern P2 is formed by a beam radiated forward from the light source unit 10C. The light distribution pattern P2 is shown together with the light source unit 10C as seen from the rear side thereof.

As shown in FIG. 11, the light distribution pattern P2 for forming the oblique cut-off line is formed as a synthesized light distribution pattern including a basic light distribution pattern P2*o* and an additional light distribution pattern P2*a*.

The basic light distribution pattern P2*o* is formed by light reflected from the first reflecting surface 14*a* (B2*o* for forming the hot zone), and it has an oblique cut-off line CL2 on the upper edge thereof The oblique cut-off line CL2 is formed at the same level as the oblique cut-off line CL2 formed by the light source unit 10.

The projection lens 18C of the light source unit 10C has a much greater rear focal length than that of the projection lens 18B of the light source unit 10B. As compared with the basic light distribution pattern P1*o* formed by the light source unit 10B, therefore, the basic light distribution pattern P2*o* is much smaller and brighter. Consequently, the basic light distribution pattern P2*o* includes a hot zone along the oblique cut-off line CL2 so as to enhance the visibility of distant regions on the road surface ahead of the vehicle.

On the other hand, the additional light distribution pattern P2*a* is formed by light reflected from the second reflecting surface 14*b* (additional radiated light B2*a*) and is formed to overlap with the lower half part of the basic light distribution pattern P2*o* and to be diffused widely in the transverse direction. The additional light distribution pattern P2*a* is also a much smaller light distribution pattern than the additional light distribution pattern P1*a* formed by the light source unit 10B due to the greater rear focal length of the projection lens 18C. Due to the additional light distribution pattern P2*a*, the visibility in portions of the basic light distribution pattern P2*o* along the side of the road surface ahead of the vehicle is enhanced.

Figure 12:
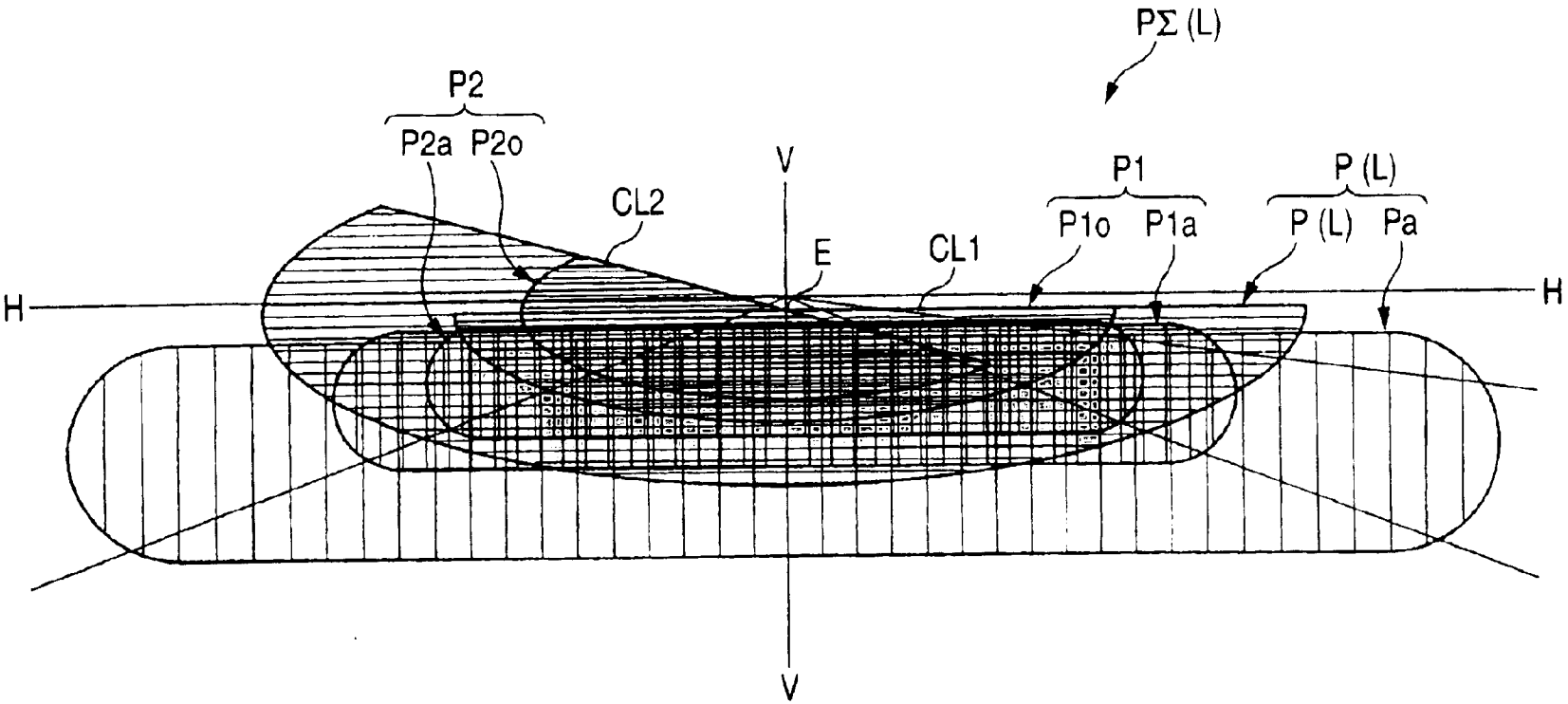
FIG. 12 is a perspective view showing a low-beam distribution pattern formed on the virtual vertical screen by a beam of a vehicular lamp employing light sources constructed according to the second embodiment.

FIG. 12 is a perspective view showing a synthesized low-beam distribution pattern PΣ(L) formed on a virtual vertical screen 25 m in front of a lighting unit by beams radiated from the vehicular lamp 100A according to this second example.

As shown in FIG. 12, the synthesized low-beam distribution pattern PΣ(L) is a composite of four low-beam distribution patterns P(L) formed by beams from four respective light source units 10. Further, the light distribution pattern P1 for forming the horizontal cut-off line is a composite of three beams radiated from three light source units 10B, and the light distribution pattern P2 for forming the oblique cut-off line is a composite of three beams from three light source units 10C.

With the vehicular lamp 100A according to this example, it is possible to obtain a synthesized low-beam distribution pattern PΣ(L) having a hot zone formed in the vicinity of an elbow point E. Consequently, it is possible to obtain low-beam radiation in a light distribution pattern providing distant visibility which is significantly enhanced.

While a vehicular lamp 100A which is constituted by a combination of three types of light source units 10, 10B and 10C has been described, it is also possible to constitute a vehicular lamp by a combination of even more types of light source units. Thus, it is possible to effect light distribution control with a high degree of precision.

Next, a third embodiment of a light source unit of the invention will be described.

Figure 13:
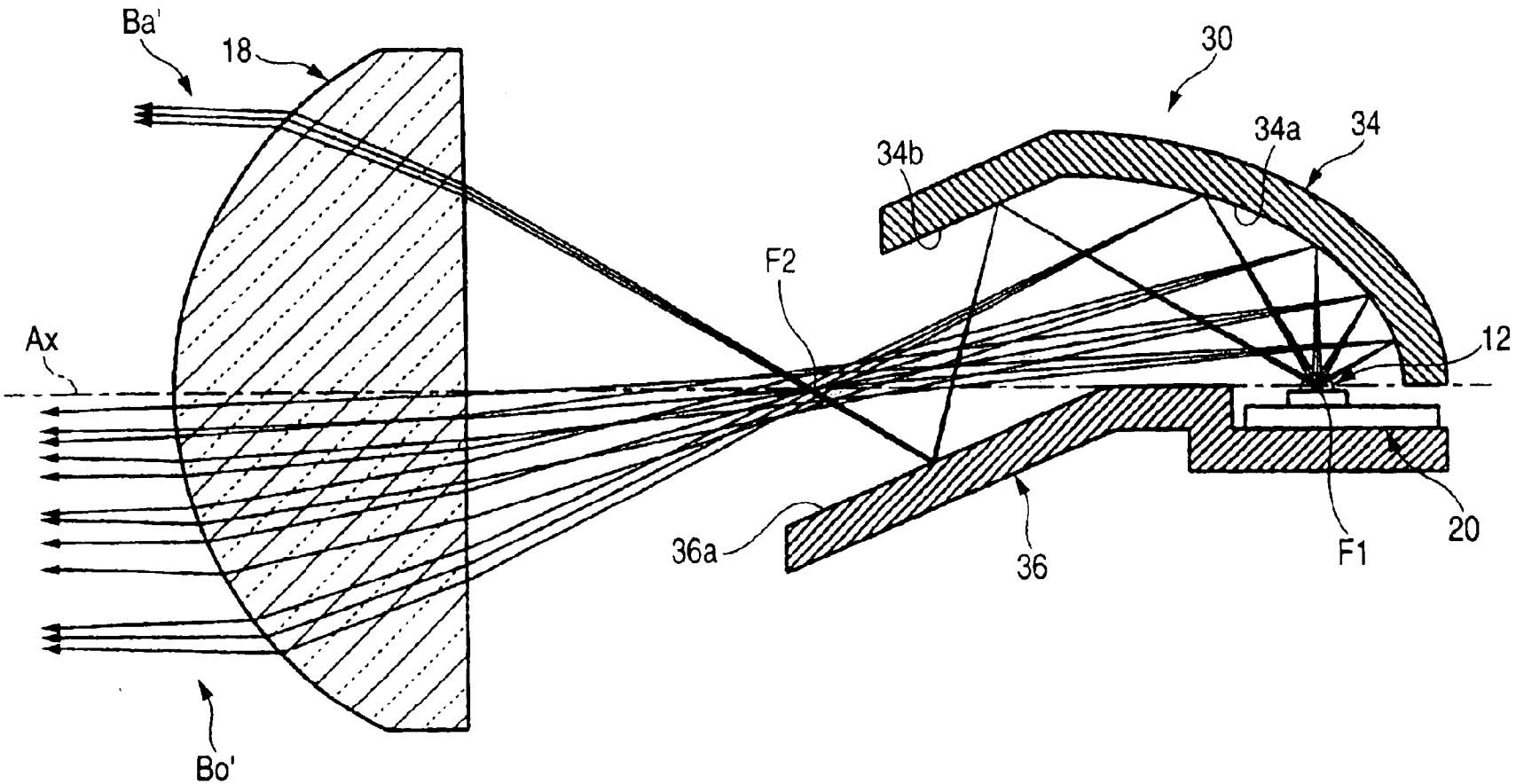
FIG. 13 is a view similar to FIG. 5 showing a third embodiment of a light source unit of the invention.

FIG. 13 is a sectional side view showing a light source unit 30 according to the third embodiment.

The light source unit 30 is designed for providing a high-beam light distribution pattern.

More specifically, the light source unit 30 according to the third embodiment is not provided with a light control member 16 as in the previously described embodiments. On the other hand, the light source unit 30 of the third embodiment has a second reflector 36 having a fourth reflecting surface 36*a* which extends forward and is inclined downward.

The structure of a first reflecting surface 34*a* is the same as that of the first reflecting surface 14*a* of the first embodiment, but the downward inclination angle of a second reflecting surface 34*b* formed at the upper part of the front end of the first reflecting surface 34*a* is greater than the angle of inclination of the second reflecting surface 14*b* of the first embodiment.

Since no light control member 16 is provided in the third embodiment, all the light emitted by the LED 12 and reflected by the first reflecting surface 34*a* is incident on the projection lens 18 and available for forming the high-beam radiated light Bo' from the projection lens 18.

In the third embodiment, moreover, light emitted by the LED 12 and reflected by the second reflecting surface 34*b* is made incident on the fourth reflecting surface 36*a* of the second reflector 36 and then reflected by the fourth reflecting surface 36*a* onto the incident face of the projection lens 18 to be emitted therefrom as additional radiated light Ba'. The direction of radiation of any given ray of the additional radiated light Ba' varies depending on the reflecting position on the fourth reflecting surface 36*a*, and generally a broad light flux at a higher position than the high-beam radiated light Bo' is radiated in a transverse direction.

Figure 14:
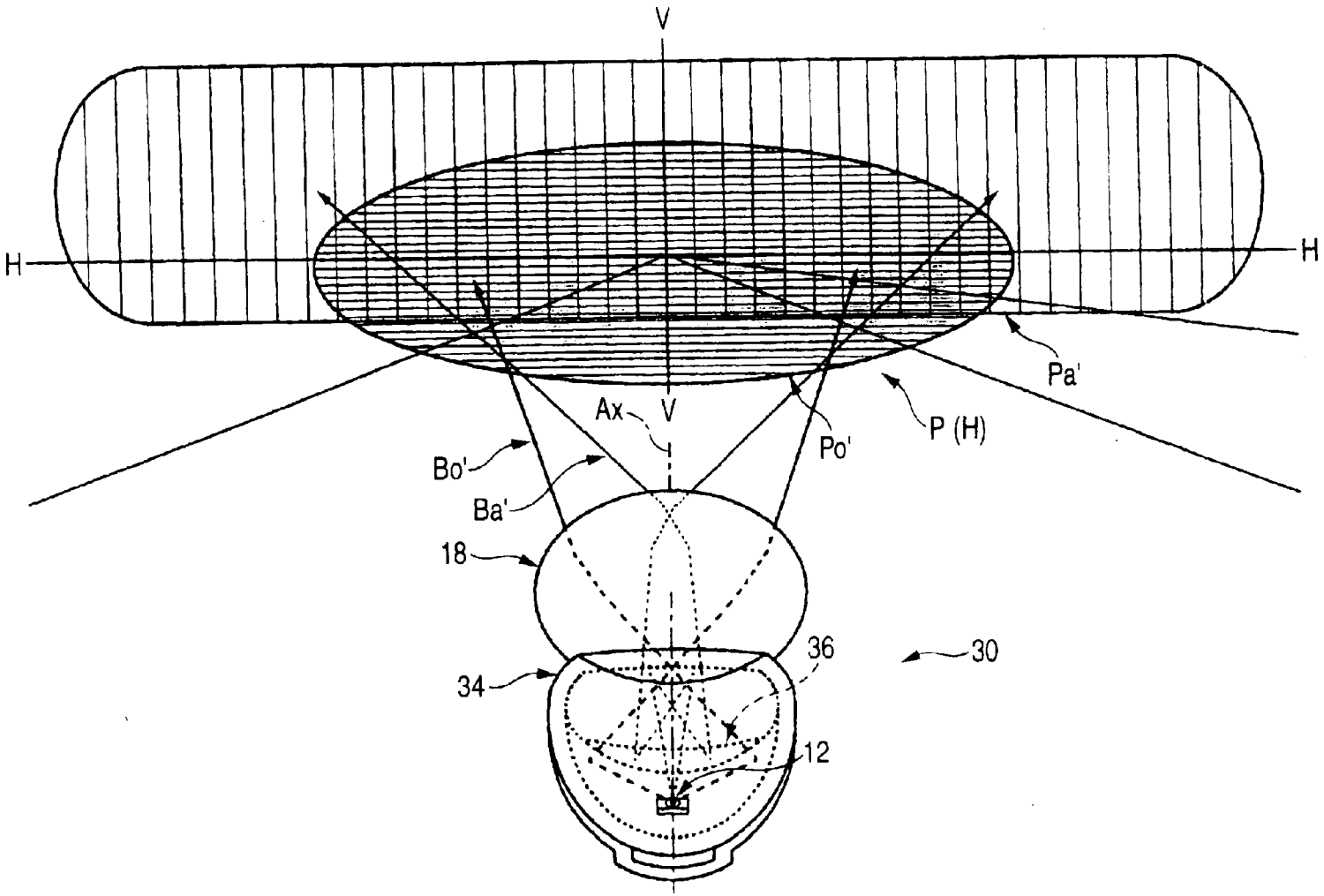
FIG. 14 is a view similar to FIG. 6 showing a light distribution pattern formed on a virtual screen by a beam of a light source unit of the third embodiment.

FIG. 14 is a perspective view showing a high-beam distribution pattern P(H) formed on a virtual vertical screen 25 m forward of the lighting unit by a beam radiated from the light source unit 30, together with the light source unit 30 as seen from the rear side thereof.

As shown in FIG. 14, the high-beam distribution pattern P(H) is formed as a synthesized light distribution pattern including a basic light distribution pattern Po' and an additional light distribution pattern Pa'.

The basic light distribution pattern Po' is formed by light reflected from the first reflecting surface 34*a* (the high-beam radiated light Bo'), and has a shape such that the basic light distribution pattern Po according to the first embodiment is extended upward. With the basic light distribution pattern Po' light is radiated forward of the vehicle in a generally wide pattern centered substantially about the H-V intersection.

The additional light distribution pattern Pa' formed by light reflected from the fourth reflecting surface 36*a* (the additional radiated light Ba') overlaps the upper half of the basic light distribution pattern Po' and is diffused widely in the transverse direction. The additional light distribution pattern Pa' provides light radiated more widely forward of vehicle.

A vehicular lamp 100 may be produced utilizing ten light source units 30 according to the third embodiment in place of ten light source units 10 of the first embodiment, or light source units 30 according to the third embodiment may be combined with light source units 10 constructed according to the first embodiment. In the case in which only light source units of the third embodiment are employed, it is possible to produce a high-beam headlamp having a high brightness, while in the case where both light source units 10 and 30 of the first and third embodiments are employed, moreover, it is possible to produce a headlamp capable of emitting either a low beam or a high beam.

While examples have been described in which the light source units 10, 10A, 10B, 10C and 30 are used in a headlamp, the light source units 10, 10A, 10B, 10C and 30 can also be used for a fog lamp or a cornering lamp while obtaining the same functions and effects as those in the above-described examples.

It should further be apparent to those skilled in the art that various changes in form and detail of the invention as shown and described above may be made. It is intended that such changes be included within the spirit and scope of the claims appended hereto.

What is claimed is:

1. A light source unit for a vehicular lamp, comprising:

a semiconductor light-emitting element disposed on an optical axis of said light source unit with its light output directed in a predetermined direction substantially orthogonal to said optical axis, and a reflector provided on a forward side in said predetermined direction with respect to said semiconductor light-emitting element, said reflector having a first reflecting surface to collect and reflect a light emitted from said semiconductor light-emitting element forward in a direction of said optical axis, said first reflecting surface being formed in such a manner that a distance in said predetermined direction from said semiconductor light-emitting element to said first reflecting surface is 20 mm or less; and a projection lens provided at a predetermined position on a forward side in said direction of said optical axis with respect to said reflector;

wherein said reflector further comprises a light control member for shielding a part of light reflected by said first reflecting surface, said light control member being provided at a predetermined position on a forward side in said direction of said optical axis with respect to said semiconductor light-emitting element;

wherein said first reflective surface is substantially dome shaped.

2. The light source unit according to claim 1, wherein said distance in said predetermined direction is approximately 10 mm.

3. The light source unit according to claim 1, wherein said reflector comprises a second reflecting surface at a front end thereof in the direction of the optical axis of said first reflecting surface, said second reflecting surface being inclined forward in said direction of said optical axis.

4. The light source unit according to claim 1, wherein the first reflecting surface is substantially elliptically shaped in cross-section with the optical axis as a central axis of the ellipse.

5. The light source unit according to claim 1, wherein the front end surface of the control member is formed such that both left and right sides of the front end surface of the control member curve forward.

6. The light source unit according to claim 1, wherein said light control member comprises a shielding end face extending rearward in said direction of said optical axis.

7. The light source unit according to claim 1, wherein a third reflecting surface for reflecting light reflected by said first reflecting surface in said predetermined direction is formed by a shielding end face.

8. A light source unit for a vehicular lamp, comprising:

a semiconductor light-emitting element disposed on an optical axis of said light source unit with its light output directed in a predetermined direction substantially orthogonal to said optical axis, and a reflector provided on a forward side in said predetermined direction with respect to said semiconductor light-emitting element, said reflector having a first reflecting surface to collect and reflect a light emitted from said semiconductor light-emitting element forward in a direction of said optical axis, said first reflecting surface being formed in such a manner that a distance in said predetermined direction from said semiconductor light-emitting element to said first reflecting surface is 20 mm or, wherein said light control member comprises a shielding end face extending rearward in said direction of said optical axis, a third reflecting surface for reflecting light reflected by said first reflecting surface in said predetermined direction being formed by said shielding end face.

9. The light source unit according to claim 8, wherein said predetermined direction is substantially orthogonal to said horizontal cut-off line forming surface.

10. The light source unit according to claim 8, wherein said predetermined direction is at an angle of approximately 15 degrees with respect to a line orthogonal to said horizontal cut-off line forming surface.

11. The light source unit according to claim 8, wherein said shielding end face comprises a horizontal cut-off line forming surface extending horizontally from said optical axis on a first side of said optical axis, and an oblique cut-off line forming surface extending obliquely and downward from said optical axis on a second side of said optical axis opposite said first side.

12. The light source unit according to claim 11, wherein said oblique cut-off line forming surface extends downward at an angle of approximately 15 degrees.

13. A light source unit for a vehicular lamp, comprising: a semiconductor light-emitting element disposed on an optical axis of said light source unit with its light output directed in a predetermined direction substantially orthogonal to said optical axis, a reflector provided on a forward side in said predetermined direction with respect to said semiconductor light-emitting element, said reflector having a first reflecting surface to collect and reflect a light emitted from said semiconductor light-emitting element forward in a direction of said optical axis and a second reflecting surface at a front end in the direction of the optical axis of said first reflecting surface, said first reflecting surface being formed in such a manner that a distance in said predetermined direction from said semiconductor light-emitting element to said first reflecting surface is 20 mm or less, said second reflecting surface being inclined forward in said direction of said optical axis, and a light control member for shielding a part of light reflected by said first reflecting surface, said light control member being provided at a predetermined position on a forward side in said direction of said optical axis with respect to said semiconductor light-emitting element, said light control member comprising a front end face and a shielding end face portion, said shielding end face portion being inclined upward and rearward from said front end face to form a third reflecting surface.

14. The light source unit according to claim 13, wherein said shielding end face is inclined upward and rearward from said front end face at an angle in a range of 1 to 10 degrees.

15. The light source unit according to claim 13, wherein said distance in said predetermined direction is approximately 10 mm.

16. The light source unit according to claim 13, further comprising a projection lens provided at a predetermined position on a forward side in said direction of said optical axis with respect to said reflector.

17. The light source unit according to claim 16, wherein said projection lens is cut away in portions receiving substantially no incident light.

18. The light source unit according to claim 13, wherein said reflector is substantially dome shaped, and wherein said first reflecting surface is substantially elliptical in a cross section in said predetermined direction and including said optical axis.

19. The light source unit according to claim 18, wherein said semiconductor light-emitting element is positioned at a first focal point of an ellipse in said cross section in said predetermined direction and including said optical axis.

20. The light source unit according to claim 19, wherein an eccentricity of said first reflecting surface increases in cross sections away from said predetermined direction.

21. A light source unit for a vehicular lamp, comprising: a semiconductor light-emitting element disposed on an optical axis of said light source unit with its light output directed in a predetermined direction substantially orthogonal to said optical axis, a first reflector provided on a forward side in said predetermined direction with respect to said semiconductor light-emitting element, said first reflector being substantially dome shaped and having a first reflecting surface to collect and reflect a light emitted from said semiconductor light-emitting element forward in a direction of said optical axis and a second reflecting surface extending forward and downward from a front end of said first reflecting surface, said first reflecting surface being formed in such a manner that a distance in said predetermined direction from said semiconductor light-emitting element to said first reflecting surface is 20 mm or less, and a second reflector positioned opposite said first reflector, said second reflector having a substantially planar reflecting surface extending forward of said light-emitting element and inclined downward with respect to said optical axis.

22. The light source unit according to claim 21, wherein said distance in said predetermined direction is approximately 10 mm.

23. The light source unit according to claim 21, further comprising a projection lens provided at a predetermined position on a forward side in said direction of said optical axis with respect to said reflector.

24. The light source unit according to claim 21, wherein said first reflecting surface is substantially elliptical in a cross section in said predetermined direction and including said optical axis.

25. The light source unit according to claim 24, wherein said semiconductor light-emitting element is positioned at a first focal point of an ellipse in said cross section in said predetermined direction and including said optical axis.

26. The light source unit according to claim 25, wherein an eccentricity of said first reflecting surface increases in cross sections away from said predetermined direction.

27. A light source unit for a vehicular lamp, comprising:

a semiconductor light-emitting element disposed on an optical axis of said light source unit with its light output directed in a predetermined direction substantially orthogonal to said optical axis, and a reflector provided on a forward side in said predetermined direction with respect to said semiconductor light-emitting element, said reflector having a first reflecting surface to collect and reflect a light emitted from said semiconductor light-emitting element forward in a direction of said optical axis, said first reflecting surface being formed in such a manner that a distance in said predetermined direction from said semiconductor light-emitting element to said first reflecting surface is 20 mm or less;

wherein said reflector further comprises a light control member for shielding a part of light reflected by said first reflecting surface, said light control member being provided at a predetermined position on a forward side in said direction of said optical axis with respect to said semiconductor light-emitting element;

wherein said first reflective surface is substantially dome shaped;

wherein said reflector is substantially dome shaped, and wherein said first reflecting surface is substantially elliptical in a cross section in said predetermined direction and including said optical axis.

28. The light source unit according to claim 27, wherein said semiconductor light-emitting element is positioned at a first focal point of an ellipse in said cross section in said predetermined direction and including said optical axis.

29. The light source unit according to claim 27, wherein an eccentricity of said first reflecting surface increases in cross sections away from said predetermined direction.

30. The light source unit according to claim 27, wherein said distance in said predetermined direction is approximately 10 mm.

31. The light source unit according to claim 27, wherein said reflector comprises a second reflecting surface at a front end thereof in the direction of the optical axis of said first reflecting surface, said second reflecting surface being inclined forward in said direction of said optical axis.

32. The light source unit according to claim 27, wherein the front end surface of the control member is formed such that both left and right sides of the front end surface of the control member curve forward.

33. The light source unit according to claim 27, wherein said light control member comprises a shielding end face extending rearward in said direction of said optical axis.

34. The light source unit according to claim 27, wherein a third reflecting surface for reflecting light reflected by said first reflecting surface in said predetermined direction is formed by a shielding end face.

35. A light source unit for a vehicular lamp, comprising:

a semiconductor light-emitting element disposed on an optical axis of said light source unit with its light output directed in a predetermined direction substantially orthogonal to said optical axis, and a reflector provided on a forward side in said predetermined direction with respect to said semiconductor light-emitting element, said reflector having a first reflecting surface to collect and reflect a light emitted from said semiconductor light-emitting element forward in a direction of said optical axis, said first reflecting surface being formed in such a manner that a distance in said predetermined direction from said semiconductor light-emitting element to said first reflecting surface is 20 mm or less; and a projection lens provided at a predetermined position on a forward side in said direction of said optical axis with respect to said reflector;

wherein said reflector further comprises a light control member for shielding a part of light reflected by said first reflecting surface, said light control member being provided at a predetermined position on a forward side in said direction of said optical axis with respect to said semiconductor light-emitting element;

wherein said first reflective surface is substantially dome shaped;

wherein said reflector is substantially dome shaped, and wherein said first reflecting surface is substantially elliptical in a cross section in said predetermined direction and including said optical axis.

36. The light source unit according to claim 35, wherein said distance in said predetermined direction is approximately 10 mm.

37. The light source unit according to claim 35, wherein said reflector comprises a second reflecting surface at a front end thereof in the direction of the optical axis of said first reflecting surface, said second reflecting surface being inclined forward in said direction of said optical axis.

38. The light source unit according to claim 35, wherein said semiconductor light-emitting element is positioned at a first focal point of an ellipse in said cross section in said predetermined direction and including said optical axis.

39. The light source unit according to claim 35, wherein an eccentricity of said first reflecting surface increases in cross sections away from said predetermined direction.

40. The light source unit according to claim 35, wherein the front end surface of the control member is formed such that both left and right sides of the front end surface of the control member curve forward.

41. The light source unit according to claim 35, wherein said light control member comprises a shielding end face extending rearward in said direction of said optical axis.

42. The light source unit according to claim 35, wherein a third reflecting surface for reflecting light reflected by said first reflecting surface in said predetermined direction is formed by a shielding end face.

* * * * *